United States Patent [19]

Tsunakawa

[11] Patent Number: 4,542,582

[45] Date of Patent: Sep. 24, 1985

[54] RELAY ASSEMBLAGE AND A METHOD OF FORMING SAME

[75] Inventor: Shoji Tsunakawa, Yokohama, Japan

[73] Assignee: Original Electric Mfg. Co., Ltd., Tokyo, Japan

[21] Appl. No.: 551,185

[22] Filed: Nov. 14, 1983

[30] Foreign Application Priority Data

Aug. 1, 1983 [JP] Japan ..... 58-118695[U]

[51] Int. Cl.[4] ..... H01H 11/02

[52] U.S. Cl. ..... 29/622; 335/83; 335/106; 335/202; 361/421

[58] Field of Search ..... 335/78, 83, 128, 106, 335/135; 29/202, 622, 602 R; 206/330; 361/421

[56] References Cited

U.S. PATENT DOCUMENTS 3,750,060 7/1973 Pfenning ..... 335/135

3,831,063 8/1974 Keough ..... 361/421

*Primary Examiner*—E. A. Goldberg

*Assistant Examiner*—George Andrews

*Attorney, Agent, or Firm*—McCormick, Paulding & Huber

[57] ABSTRACT

A method of forming a relay assemblage essentially consisting of a contact block and a coil block, comprising locating a united connection terminals in the base member of the contact block, cutting the joint uniting the terminals, and coupling the coil block with the contact block by elastic engagement.

2 Claims, 13 Drawing Figures

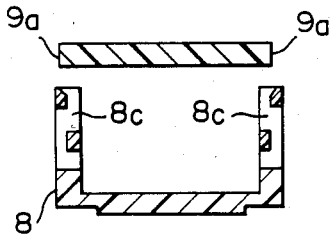
FIG. 6A
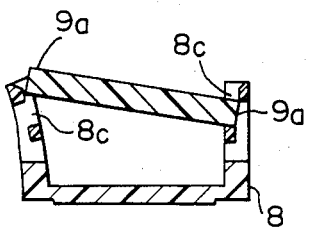
FIG. 6B
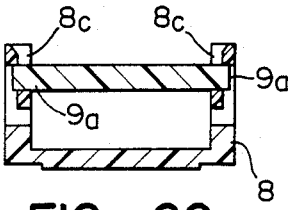
FIG. 6C
FIG. 7
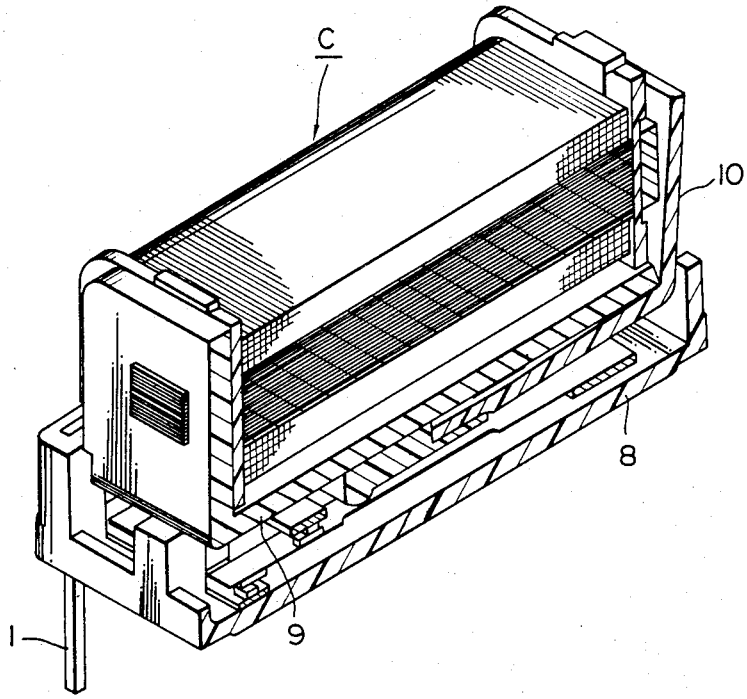

RELAY ASSEMBLAGE AND A METHOD OF FORMING SAME

The invention relates to a relay assemblage with plural external connection terminals extending in the form of pins in the same direction, a relay assmeblage essentially consisting, for instance, of a coil block and a contact block.

In the conventional relay assemblage of a type provided with plural external connection terminals extending in the same plane, usually the external connection terminal pins had to be set up individually on the base member of the contact block or joined external connection terminals were coupled to the base member of the contact block such that the base member is molded with the terminals inserted in the mold, thus requiring precise molding technique and complicated molding devices or, alternatively, the connection terminal board was subjected to bending or contacts welding operation. However, all these were time consuming, required complicated devices and high level techniques and lowered work efficiency so that there have remained problems to be solved for mass production of relay assemblages.

The object of the invention is to obviate such disadvantages of the prior art and provide a relay assemblage which is simple in construction and can be assembled in high work efficiency.

This object is achieved by the present invention characterized in that, in a relay assemblage comprising a coil block and a contact block, the contact block is composed of a base member made of an insulating material and external connection terminals made of a conductive material, that the external connection terminals are united by joints, and that the terminals are inserted, from the side of the contact block on which the coil block is coupled with the contact block, through the holes formed in said base member so as to project out of the contact block, thereafter cutting off the remaining joint from the terminals.

An embodiment of the invention will now be described with reference to the drawings in which.

Figure 3:
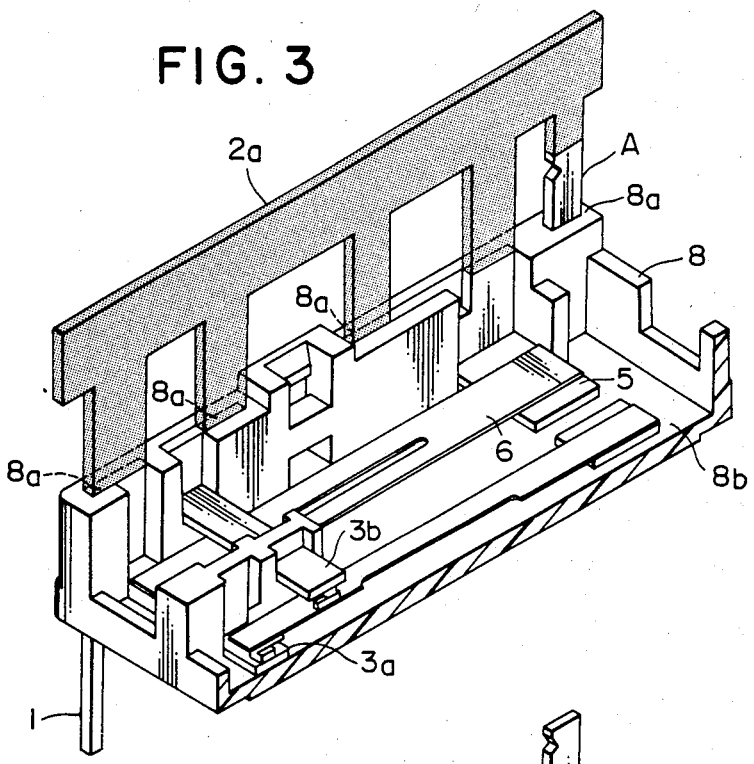

FIG. 3 is a perspective view of the terminal board A with the terminals 1 inserted through the respective holes 8*a* of a base member 8.

Figure 4:
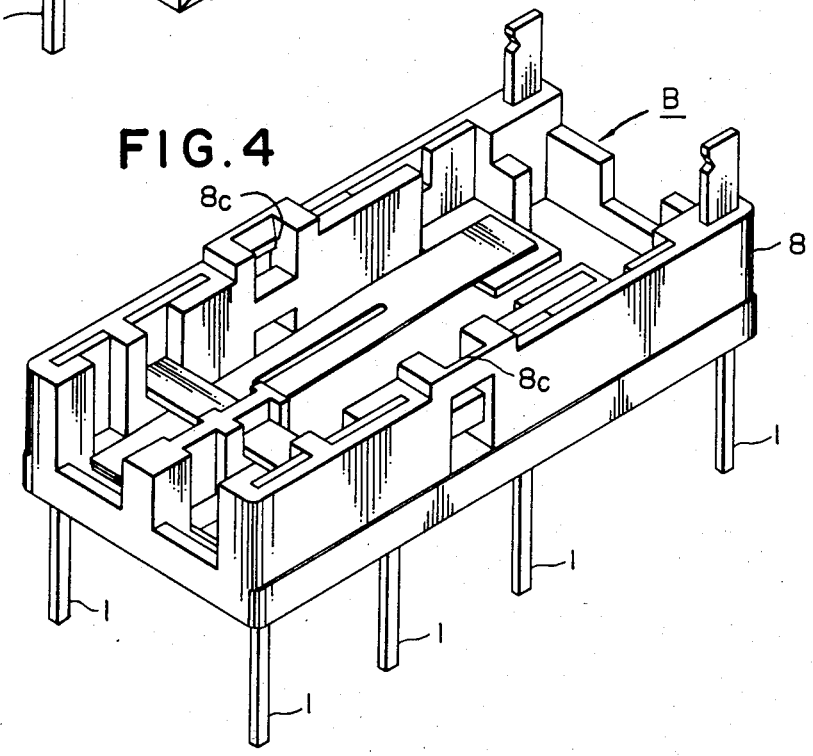

FIG. 4 is a perspective view of a contact block B made up by locating the terminal board A on both sides of the base member 8 and then cutting off the now useless portions.

Figure 5:
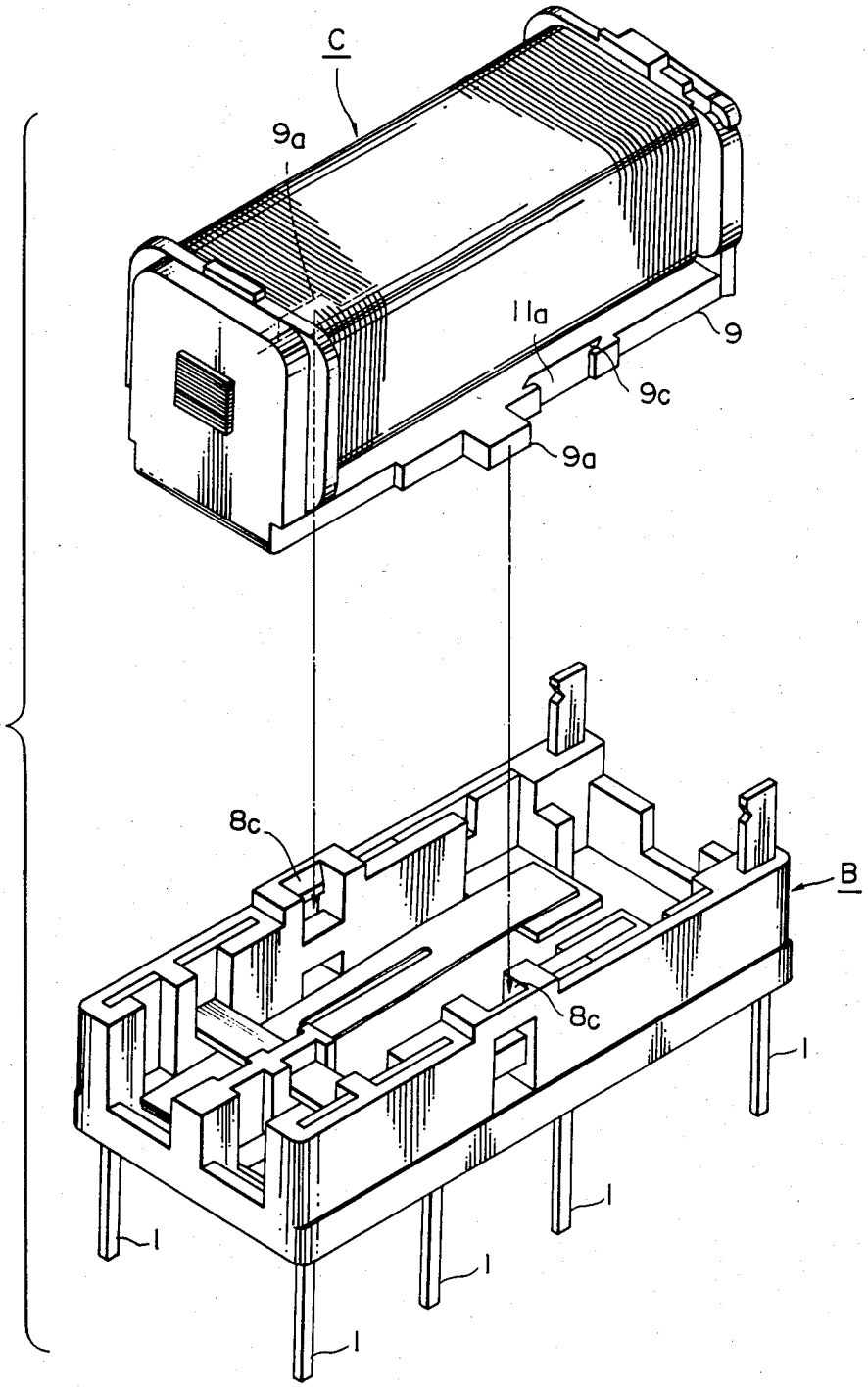

FIG. 5 is a perspective view showing how a coil block C is mounted on the contact block B.

FIG. 6 (*a*) to (*c*) to the steps through which the coil block C is elastically engaged with the contact block B.

FIG. 7 is a sectional perspective view showing the coil block C mounted on the contact block B.

Figure 8:
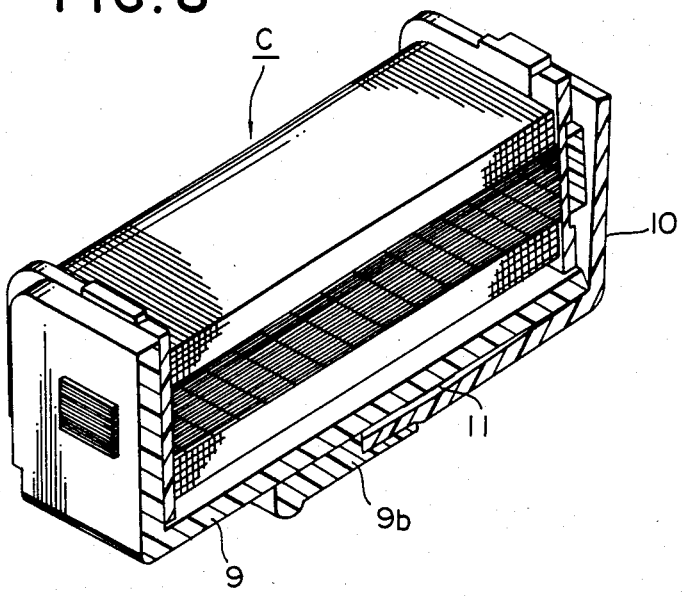

FIG. 8 is a sectional perspective view of the coil block C as shown in FIG. 7.

Figure 9:
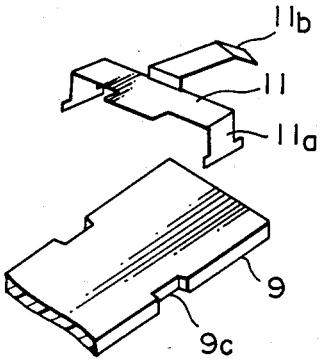
Figure 10:
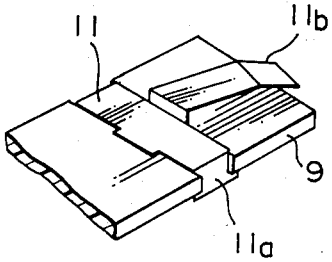

FIGS. 9 and 10 are perspective views showing how a hinge spring 11 is attached to a frame 9 of the contact block B in elastic engagement.

Figure 11:
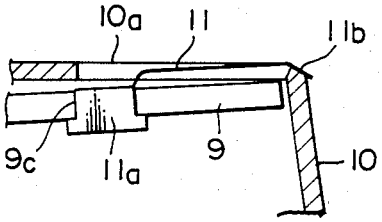

FIG. 11 is a partly sectional view showing the hinge springe 11 in elastic engagement with a moving iron member 10.

Figure 1:
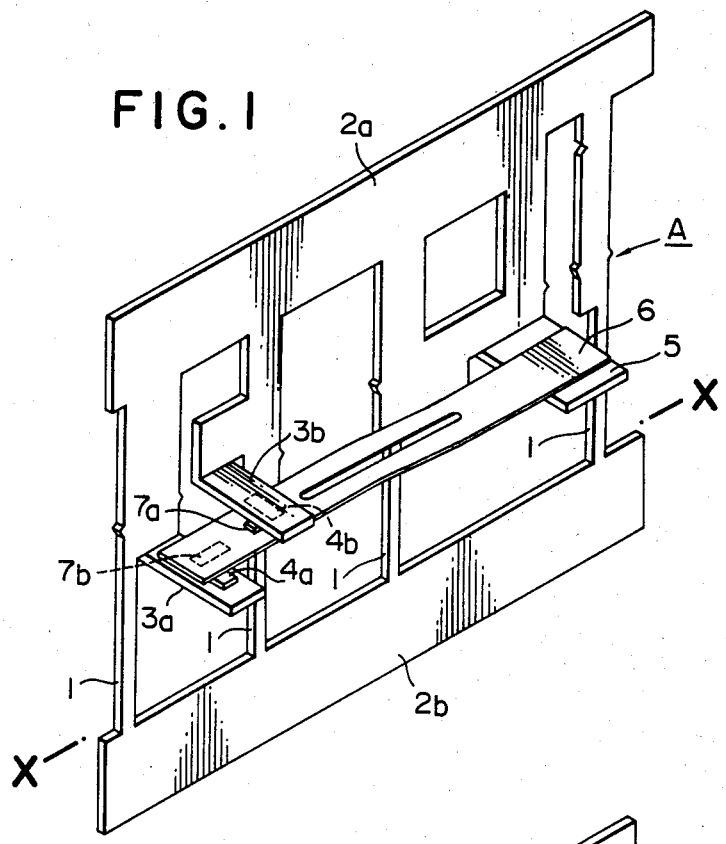
FIG. 1 is a perspective view of a terminal board A with terminals 1 including, for instance, a contact terminal, common terminal, coil terminal, etc., united by joints 2*a*, 2*b*.

FIG. 1 shows a terminal board A comprising, for example, a contact terminal, a common terminal, a coil terminal, etc. united by joints 2*a*, 2*b*. The terminal board A, obtained, for instance, by blanking a conductive material sheet, has bent portions 3*a*, 3*b* with contact pieces 4*a*, 4*b* welded thereto, respectively and another bent portion 5 with a movable spring member 6 welded to it. The spring member 6 is provided with contact pieces 7*a*, 7*b*.

Figure 2:
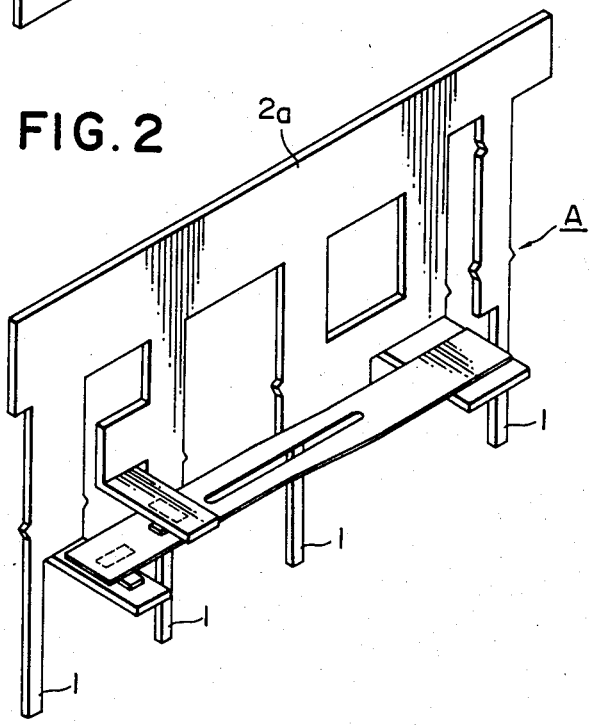
FIG. 2 is a perspective view of the terminal board A with the now useless joint 2*b* cut off from the line X—X on FIG. 1.

FIG. 2 shows a terminal board A with the now useless joint 2*b* cut off from the line X—X on FIG. 1. The terminal board A as shown in FIG. 2 is inserted into a base member of a contact block to be seen, whereon the joint 2*a* also is cut off.

FIG. 3 shows the termminal board A as coupled to the base member 8 of a contact block, with the terminals 1 inserted through holes 8*a* formed in the base member 8. The terminal board A is coupled to the base member 8 so that the terminals extend through and out of the bottom 8*b* of the base member 8 and the bent portions 3*a*, 5 rested on the bottom 8*b*.

Since the plural terminals 1 are united by the joint 2*a*, insertion of the terminal board A into the base member 8 makes it possible to locate the plural terminals in the base member 8 at a time.

In FIG. 3, after the terminal board A is located in the base member 8, the part indicated by dots including the joint 2*a* is useless and therefore cut off.

FIG. 4 shows a contact block B made up by locating the terminal boards A at both sides of the base member 8 and then cutting off the respective useless parts. A coil block to be described is mounted on this contact block B.

Referring to FIG. 5, the contact block B has recesses 8*c* provided with a tapered edge. The recesses 8*c* receive projections 9*a* formed on a frame 9 of a coil block C in elastic engagement.

FIG. 6(*a*) to (*c*) shows the steps through which said elastic engagement is realized. FIG. 6 (*a*), (*b*) and (*c*) shows the cross section of the frame 9 of the coil block C and the base member 8 including recesses 8*c*.

FIG. 7 shows the coil block C as mounted on the contact block B. Thus when the relay assemblage is to be examined, the coil block and contact block thereof may readily be separated and examined and/or repaired individually.

FIG. 8 shows a sectional perspective view of the coil block C. A movable iron member 10 is in a movable engagement with an extended portion 9*b* of the frame 9 as shown. A hinge spring 11 is provided in elastic engagement with the frame 9 as will be described. The coil block C is formed as so-called hinge type relay.

Referring to FIGS. 9 and 10, the hinge spring 11 is attached to the frame 9 in elastic engagement, with its arm members 11*a* inwardly biased so as to pinch cuts 9*c* of the frame 9. The hinge spring 11 has an engagement member 11*b* which is adapted to elastically engage with the moving iron member 10.

FIG. 11 shows the hinge spring 11 in elastic engagement with the moving iron member 10. The moving iron member 10 has a hole 10*a* in which the engagement member 11*b* of the hinge spring 11 is inserted. FIG. 11 shows the engagement member 11*b* in elastic engagement with the movable iron member 10.

One of the arm members 11*a* of the hinge spring 11 as in elastic engagement with the frame 9 can be also seen in FIG. 5.

Thus no special jigs or fittings are necessary to attach the hinge spring 11 to the frame 9. Further, with the movable iron member 10 attached, an armature stroke can be examined.

Thus work efficiency is greatly enhanced according to the invention as compared with the prior art in which the hinge spring is fixed by peening, or the hinge spring 11 is mounted outside and the moving iron member (armature) is fixed in position after assembling.

We claim:

1. A method of assembling a relay comprising the following steps:

(a) providing a contact block of insulating material, (b) providing a terminal strip of conductive material, (c) forming laterally opened recesses in one side of the terminal strip to define depending legs, (d) bending at least one of said depending legs at approximately right angles to a plane of the strip, (e) inserting some of said legs into openings provided in the contact block so that end portions of at least said some of said legs extend downwardly through the contact block to define terminals, and so that a bent portion of at least said one depending leg forms a contact element on an upper surface of the contact block, and (f) severing the strip contiguous with a top side of the contact block generally opposite from that which the terminals extend, (g) providing a coil block having lower portions adapted to mate with resilient upstanding wall portions defined in the contact block, and assembling said blocks by resiliently deforming at least one of said upstanding wall portions of the contact block.

2. The method of claim 1 further characterized by the steps of assembling a spring between the coil block and providing an armature of the relay, forming the spring from flat elastic material to have a T-shape such that the top of the T has depending end tabs, and forming notches in the armature to receive said tabs.

* * * * *